US006758016B2

(12) United States Patent
Gobeil

(10) Patent No.: US 6,758,016 B2
(45) Date of Patent: Jul. 6, 2004

(54) ADJUSTABLE SUPPORT FOR STEPS

(76) Inventor: Eric Gobeil, 1162 rue Desjardins, Cap Rouge, Quebec (CA), G1Y 2B3

( * ) Notice: Subject to any disclaimer, the term of this patent is extended or adjusted under 35 U.S.C. 154(b) by 0 days.

(21) Appl. No.: 10/094,545

(22) Filed: Mar. 8, 2002

(65) Prior Publication Data

US 2002/0124492 A1 Sep. 12, 2002

(30) Foreign Application Priority Data

Mar. 8, 2001 (CA) ..... 2339527

(51) Int. Cl.[7] ..... E04F 11/022

(52) U.S. Cl. ..... 52/191; 52/105; 52/715; 33/421; 33/428; 33/429; 33/476; 33/480; 33/494; 182/228.3; 248/207; 248/270.1; 248/300

(58) Field of Search ..... 52/182, 183, 191, 52/105, 715, 184, 190, 712; 33/476, 481, 474, 480, 483, 420, 427, 428, 429, 479, 421, 494; 248/300, 542, 544; 182/93, 182, 188, 220, 228.1, 228.3

(56) References Cited

U.S. PATENT DOCUMENTS 2,724,466 A * 11/1955 Phillips
4,280,282 A * 7/1981 Wright ..... 33/418
4,709,520 A * 12/1987 Vochatzer ..... 52/191
5,636,483 A * 6/1997 Wille ..... 52/188
5,791,101 A 8/1998 Wallace
5,799,448 A 9/1998 Dunk
5,806,254 A * 9/1998 Bennett ..... 52/182
5,899,032 A * 5/1999 Buzby ..... 52/182
6,018,880 A * 2/2000 Wiggins ..... 33/474
6,088,977 A * 7/2000 Lawrence ..... 52/182
6,494,015 B1 * 12/2002 Critchlow ..... 52/749.1

* cited by examiner

*Primary Examiner*—Carl D. Friedman
*Assistant Examiner*—Yvonne M. Horton

(57) ABSTRACT

A support for steps, having the shape of a triangular corner plate to be installed one after the other along a stringer. The sides of this support are reinforced, horizontally and vertically by a 90 degree fold, to fix the steps and risers. The ends are wider and possess a number of fixing holes to provide more stability when fixed against a stringer. The horizontal side is ended by a projecting horizontal rule. The wide part of the vertical side is flanked by vertical graduations. The horizontal rule is set against a stringer at a desired step run and the vertical graduations are set against the stringer at a desired step rise. The horizontal rule overlaps the vertical graduations of the preceding support.

11 Claims, 8 Drawing Sheets

ADJUSTABLE SUPPORT FOR STEPS

BACKGROUND OF THE INVENTION

1. Field of the Invention

This invention relates to stairs structure, particularly supports to position the steps and risers along a stringer.

2. Description Of The Prior Art

Certain patents particularly drew our attention:

U.S. Pat. No. 6,088,977 Lawrence, Jul. 18$^{th}$, 2000, illustrates a method and an apparatus to build staircases. It comprises a support to build steps supported by a longitudinal beam. Several holes allow different heights and lengths, that is the tread of the steps. The support is made of a central block with legs that overlap the stringer. A total of four (4) parts is required. The external sheet is visible and must be covered.

U.S. Pat. No. 5,899,032, Buzby, May 4, 1999, illustrates a staircase structure. It shows supports for steps. The horizontal side has a flared portion 8, which allows adjusting the height. The step run cannot vary.

U.S. Pat. No. 4,709,520, Vochatzer, has sides comprising two lower brackets 42,48 screwed in place, without means to control height or length. Top strip 29 is positioned lengthwise onto a dotted stringer thanks to a return 32. The same applies to the flanges 59,58. Locating flanges are measured beforehand to correspond to a desired slope, for instance 7 inch rise and 11 inch length. Such a system cannot be adapted to various slopes unless designed at the time of stamping of bracket 41.

OBJECTS OF THE INVENTION

It is a general objective of the invention to provide a support for steps that can be used for all types of staircases and be easy to install. This support includes a horizontal side, which supports the steps on the stringer while allowing a variation of angle of the stringer. At the same time a vertical side allows fixing the riser.

Another objective is to provide a support for steps including a corner plate whose ends include wider parts intended to overlap, when installed. These sides, horizontal and vertical, have reinforcements to fix the steps and risers. Moreover, the wide part of the horizontal side may include a horizontal adjustment slit and the wide part on the vertical side includes a series of holes among which at least one will coincide with the slit at the time of the installation. Each wide part comprises a second series of fixing holes, sufficiently spaced apart to secure the contact with the stringer. Instead of a slit one may use a pair of overlapping rulers.

BRIEF DESCRIPTION OF THE DRAWINGS

The present invention will be further understood from the following description with reference to the drawings in which.

DETAILED DESCRIPTION OF THE PREFERRED EMBODIMENT

Figure 1:
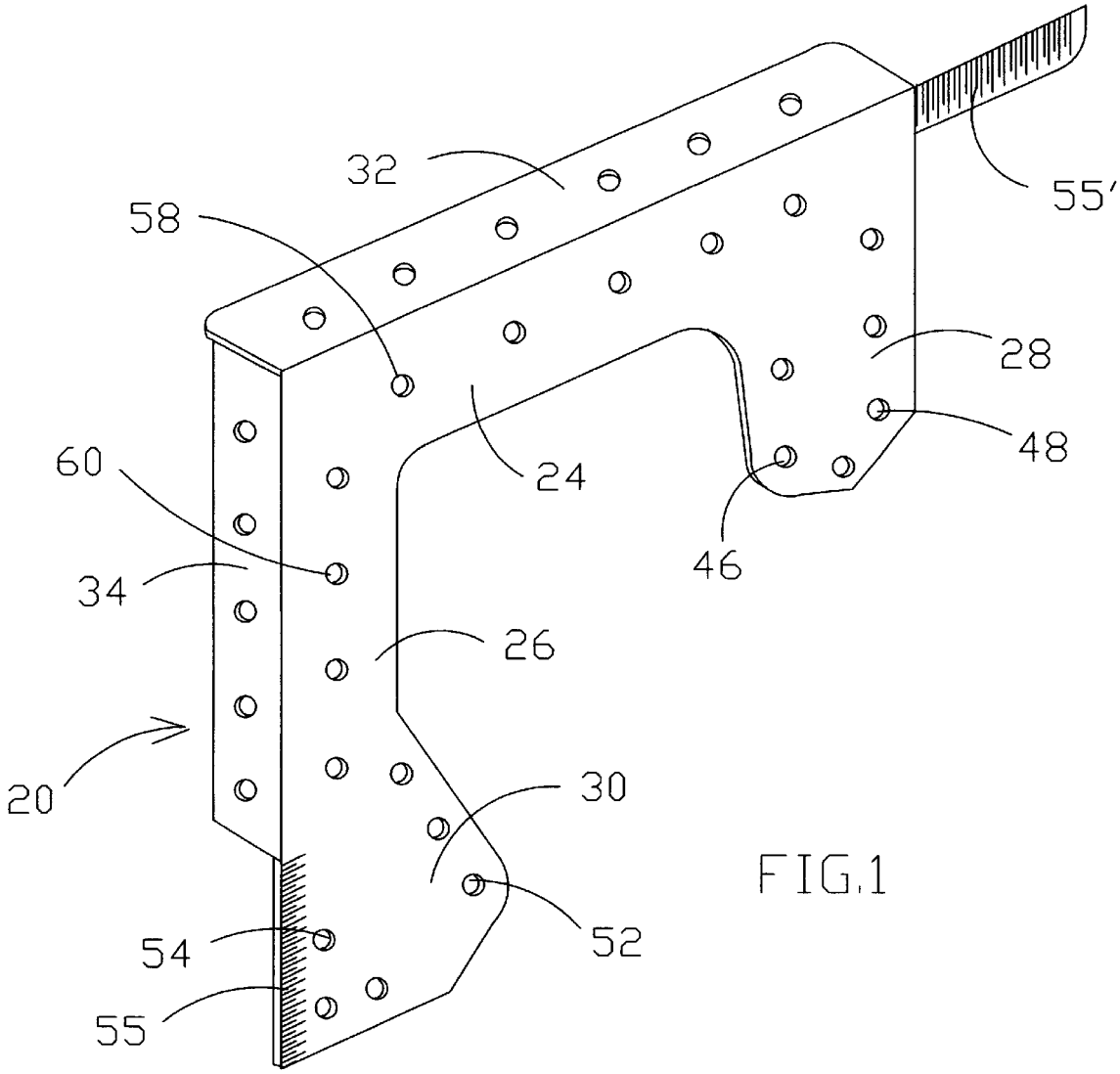
FIG. 1 is a perspective of a support for steps.

An embodiment of the invention is illustrated in the drawings wherein the same numbers identify the same characterising elements.

FIG. 1 shows a support for steps 20 identified by an arrow. The support for steps 20 is a metal piece at right angles defining a set-square, with a horizontal side 24 and a vertical side 26, which widen out to create an upper wide part 28 and a lower wide part 30. Each side is folded to make an L-shaped section, that is a horizontal fold 32 and a vertical fold 34. The upper wide part 28 includes some close holes 46 close with respect to the centre of the support 20 and some further apart 48 and a series of horizontal 58 and vertical holes 60. The lower wide part 30 has a series of holes, some closer 52 and some farther apart 54. The wide part 30 of the vertical side 26 is graduated 55 to measure a step rise of the support 20. A ruler 55' is placed on the horizontal side 24 to measure a step run of the support 20. This ruler 55' can be fixed, removable, flexible or magnetised.

Figure 2:
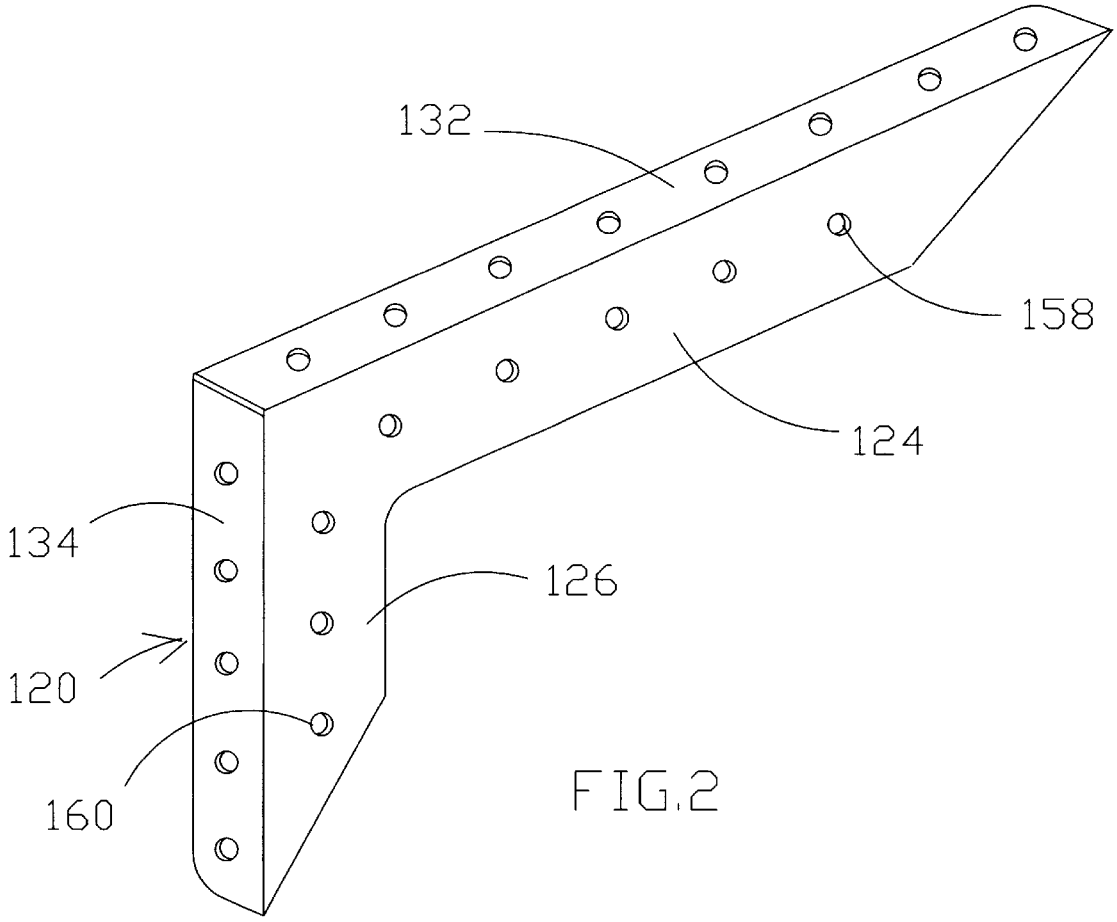
FIG. 2 is a perspective of an alternative to the support of FIG. 1.

FIG. 2 shows an alternative identified by an arrow as "French" support 120. The French support 120 is adapted to be installed on the inner side of a stringer, that is to support steps and risers according to the method known as "French". There is a horizontal side 124 and a vertical side 126, a horizontal fold 132 and a vertical fold 134. There also are horizontal 158 and vertical holes 160.

Figure 3:
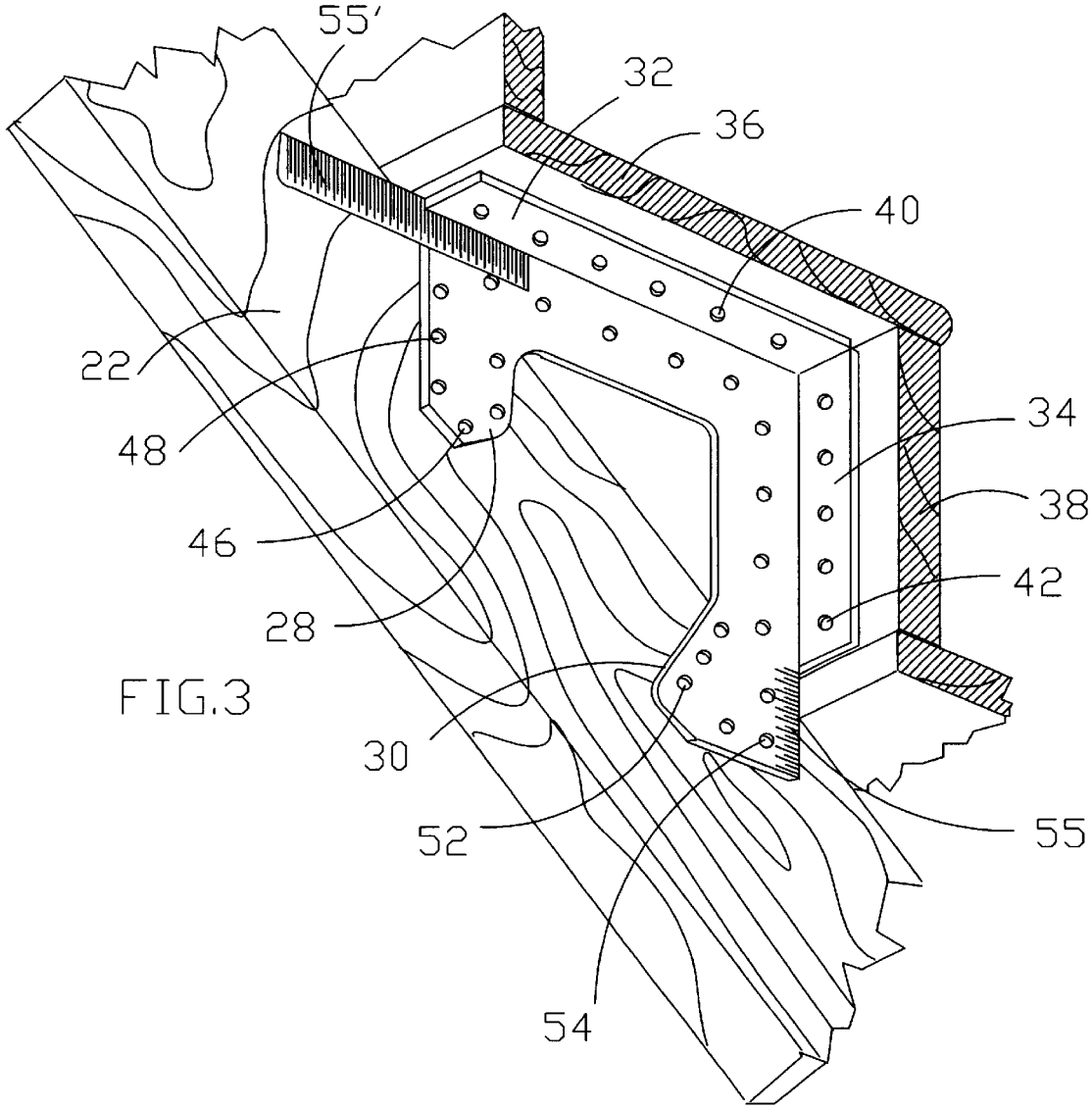
FIG. 3 shows the support of FIG. 1, installed on top of a stringer.

FIG. 3 shows the support of FIG. 1 installed on top of a stringer, according to a method known as "English", that is fixed on the inner side of the stringer and straddling the stringer. A tread 36 will be fixed to the horizontal fold 32 by screws 59 (see FIG. 4). A riser 38 is fixed on the vertical fold 34. The horizontal part of a step, known as the step run of the tread, must be of at least 8¼" to comply with certain building codes such as the Canadian national building Code. A short support allows a step run between 8¼" and 10½". The shorter step run corresponds to the length of the horizontal fold, providing a maximum of resistance. A larger support provides step runs from 10¼" to 12½". The same applies to the height known as step rise of the riser, which generally varies from 6" to 8". The horizontal 32 and vertical 34 folds have a series of holes for step 40 and riser 42 to fix them in place. In upper wide part 28 two screws are installed one in closer holes 46 and another screw in remote holes 48. There also is a ruler 55' on the horizontal part. Graduations 55 are drawn on the end of the vertical part. In lower wide part 30 two screws are installed, one in close hole 52 and another screw in remote hole 54.

Figure 4:
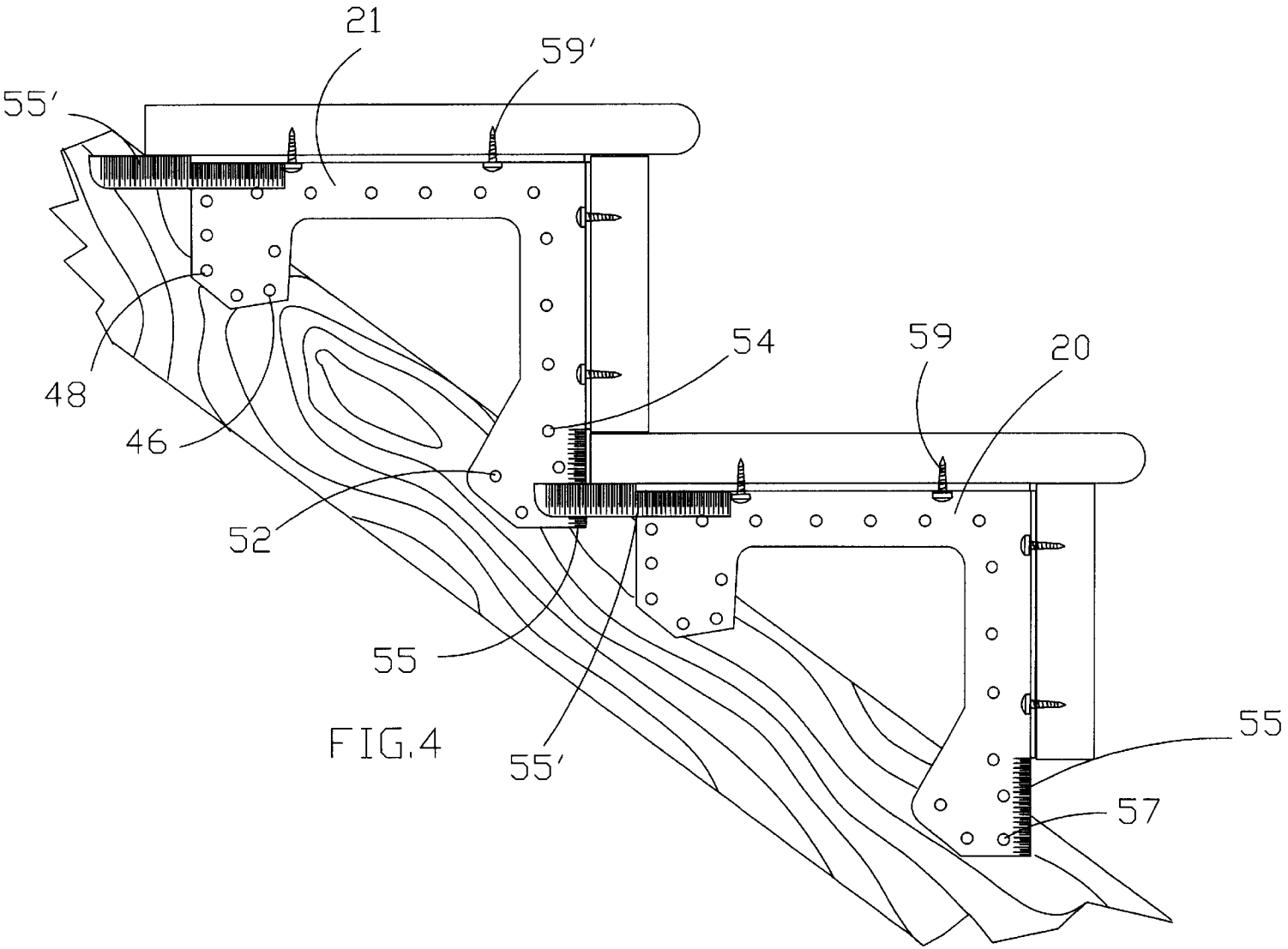
FIG. 4 is a side view of the support of FIG. 3.

FIG. 4 shows the coupling of supports for step 20 inferior and 21 superior. Upon installation one positions the upper support 21 first, followed by the next lower support 20 The ruler 55' of support 20 is placed so it gives the step run and the graduations 55 of support 20 are positioned according to the desired step rise then the support is screwed to the stringer. The lower wide part 30 of the support for steps 21 is under the rule 55' of the support for steps 20 just above. First, the support is fixed on the stringer with series of holes that are closer together 52 and 46. Then with the series of holes that are farther apart 48,54 when the step run of tread and the step rise are determined with the graduations 55. The series of holes that are further apart 54 forms a line of three holes, one of which will be used. This hole becomes a point of coupling 57 and receives a screw #8. One sees such a screw 59 used to hold steps. The metal of the support 20 is thin enough to be sawed with the stringer 22. This makes the completion of the staircase much easier, as it is possible to cut the stringer 22 and support 20 at the foot of the staircase. In the present drawing, the support 20 is installed according to the method known as "English", the support 20 being above the stringer 22.

Figure 5:
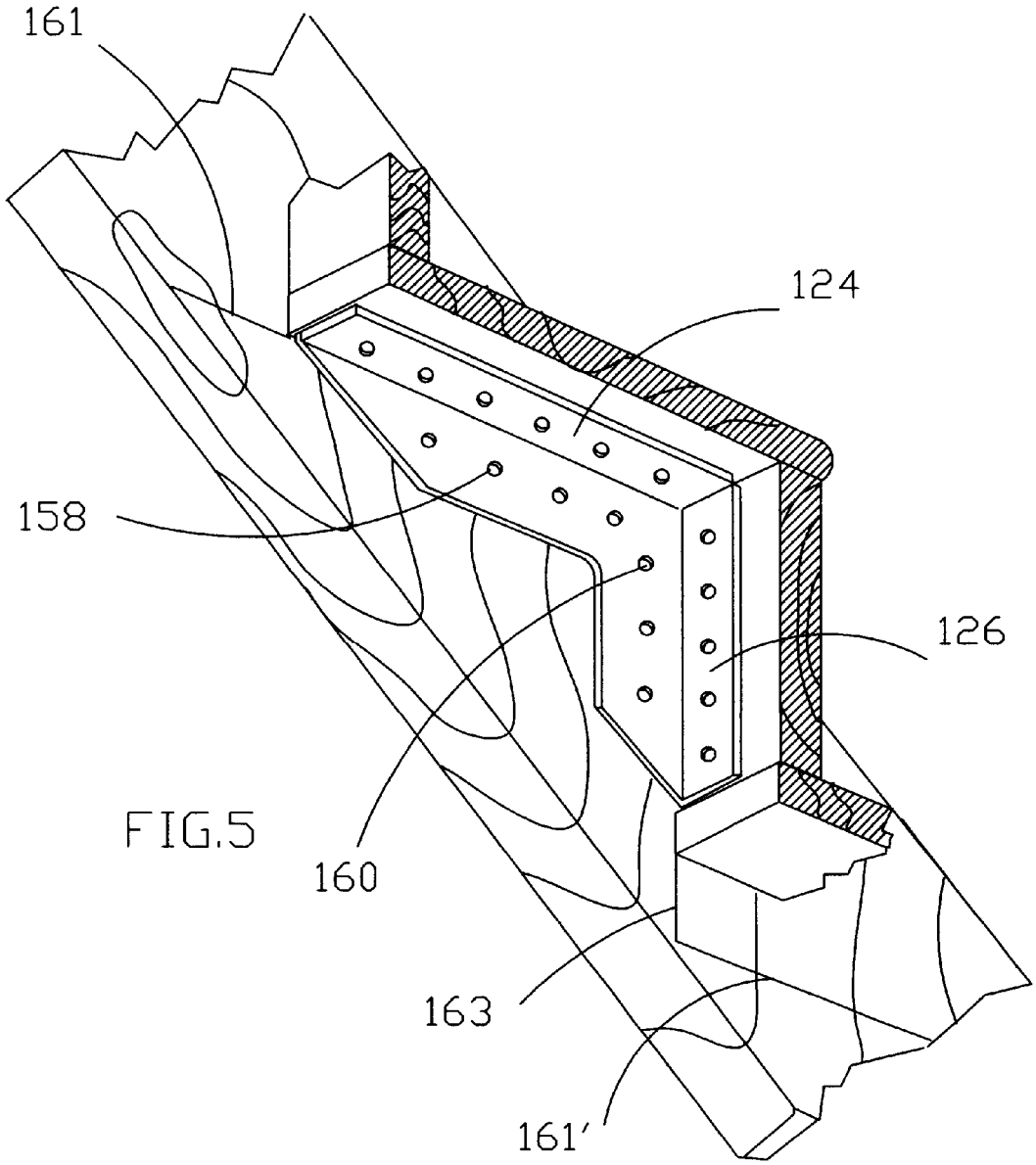
FIG. 5 shows the support of FIG. 2, installed against a stringer.

FIG. 5 illustrates another method that can be used with the support of step 120 that is known as "French". It shows the support of FIG. 2 installed against the inner side of the stringer 122. The support for steps is fixed with a series of horizontal 158 and vertical holes 160 located on the horizontal 124 and vertical 126 sides. To install, one draws horizontal 161 and vertical 163 lines on the inner side of the stringer according to step run and step rise.

Figure 6:
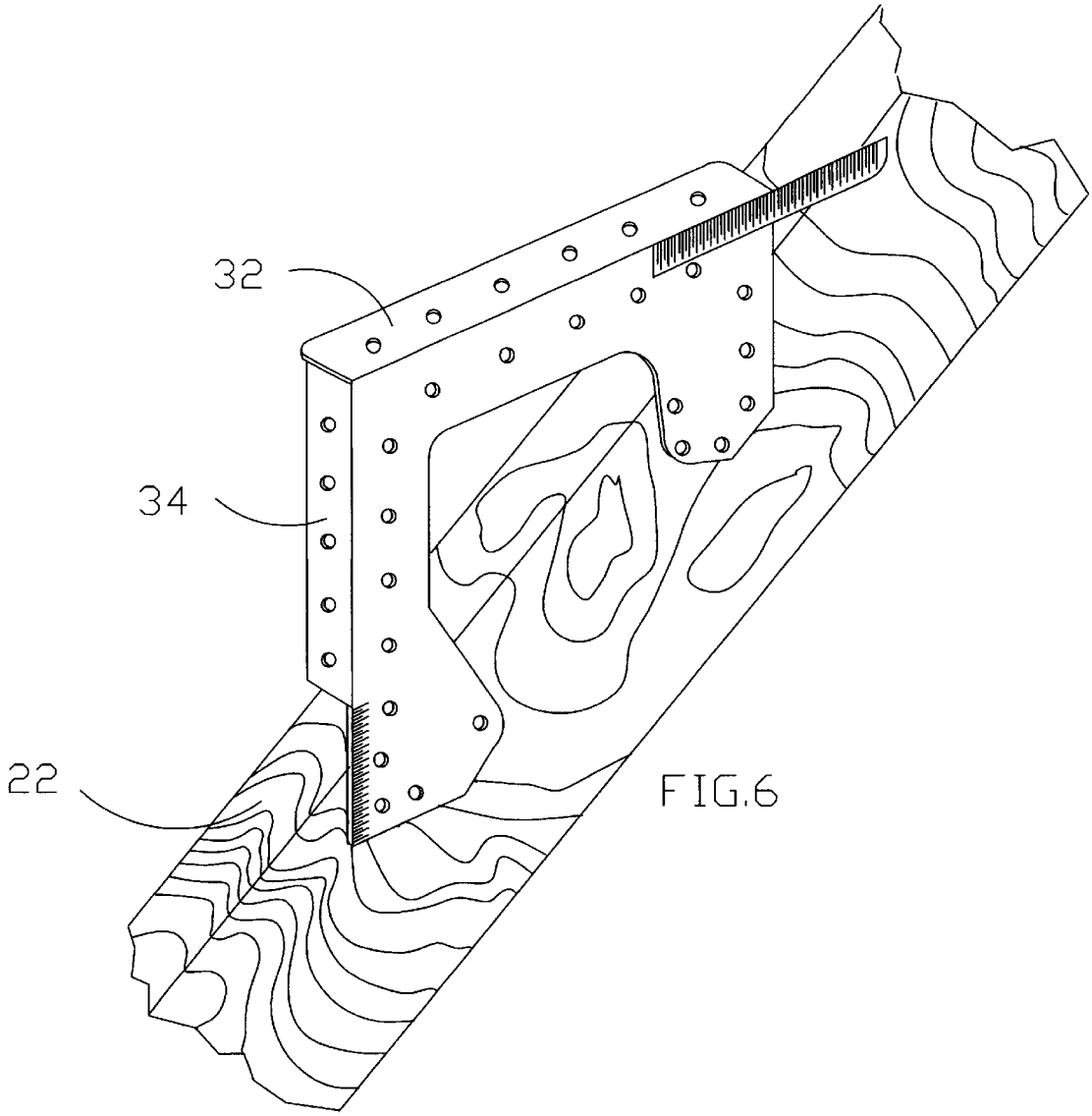
FIG. 6 shows the support of FIG. 3, installed as an alternative.

FIG. 6 shows the support of FIG. 3 installed on the inner side of a stringer. This is an alternative to the "English" method. It differs from that of FIG. 3 in that the horizontal 32 and vertical 34 folds, although the support 20 is fixed on the inner side of the stringer 22, are directed towards the outer side of the stringer while being above the stringer. The disadvantage of this alternative is the difficulty in screwing steps and risers from the outer side of the staircase.

Figure 7:
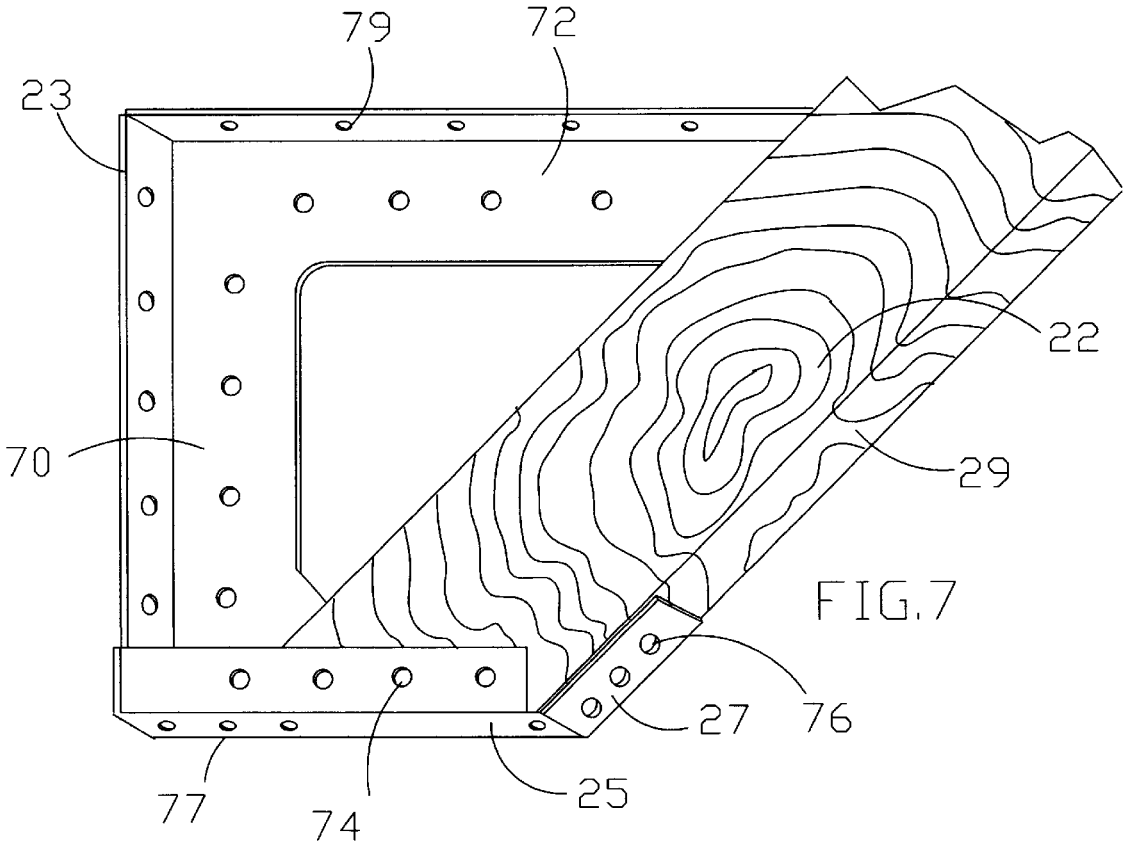
FIG. 7 is a perspective for the foot of a staircase.

FIG. 7 shows a foot support 23 at the foot of the staircase that was cut in its vertical side 70. The horizontal side 72 is fixed on the inner side of the stringer. One sees a base 25, ending with a strip 27 that folds on the back 29 of the stringer. To install, one fixes the base 25 at the foot of the stringer with screws 74. The builder then fixes the strip with screws 76. One fastens the staircase to the floor with a screw into the heel 25 through a floor hole 77 and positions a first step by means of a step hole 79.

Figure 8:
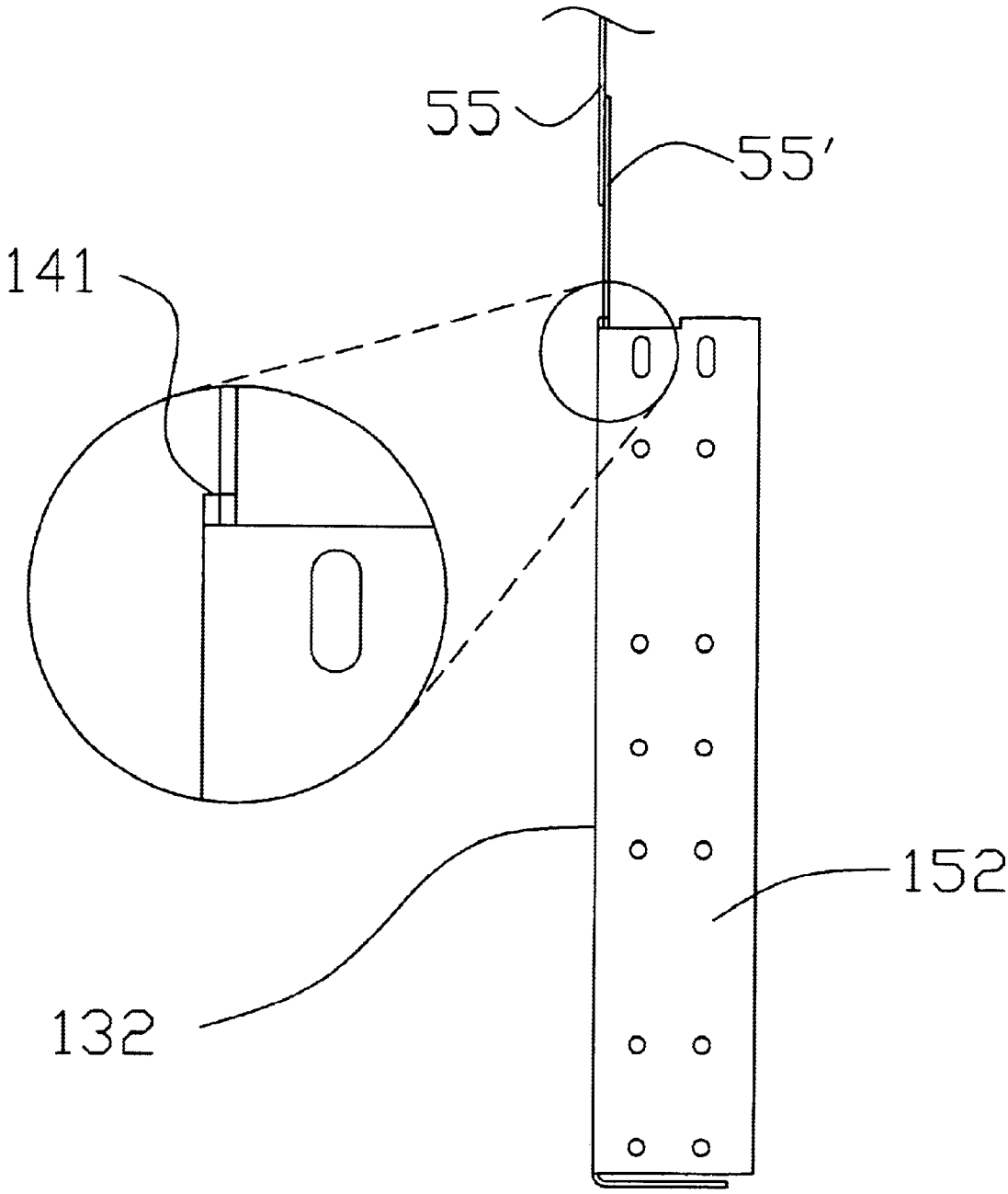
FIG. 8 is a top view of the support of FIG. 1 in mirror image.

FIG. 8 indicates a ruler offset 141 of the thickness of the wide part away from the bearing face 132.

METHODS OF INSTALLATION

The measurements mentioned in the description are the reflection of the standards of Quebec and Canada. These will vary in accordance with the country where the support for steps is used. For example, the minimal step run, stated as 8¼" in description, will be 9" if the support for steps is adapted to the American market.

The support for steps is fixed on the stringer. The horizontal and vertical folds form a right angle. The wide parts on the horizontal and vertical sides are important for the strength of the supports.

It is possible to use adjustment slits. However graduations allows adjusting a support in relation with the support directly over or above. Horizontal graduations can be on parts that are removable, flexible or even replaceable. Some characteristics of the steps themselves must be taken into consideration. The staircase may be of the "French" type where the steps are installed inside the stringer. The staircase can be of the so-called "English" type, where the steps are installed over the stringer. The English type may also be referred to as "rack" when the stringer is cut, the stringer being made of wood. When the stringer is not cut, the type may nevertheless be referred to as "rack" as the supports are fixed on the stringer by their wide parts. FIG. 6 shows the "English" type and FIG. 5 shows the "French" type. The French support is similar to the English support but for the wide parts that are not necessary as the support is fixed against the sides both horizontally and vertically. It suffices to draw an outline with a pencil and a set-square. The supports are aligned on the outline and screwed in this position. In the case of the "English" type, the support is positioned with the vertical and horizontal rulers and fixed through the wide part.

SUMMARY Upper and lower wide parts provide a structure for firmly fixing such as by screws the adjustable supports to a stringer. The supports are separate and do not overlap, in order to prevent torsion. In addition the horizontal ruler projecting from the side of the support is offset from the base plane of the support and extends to cover the vertical side of a neighbouring support to match the neighbouring vertical ruler. After screwing a support the horizontal ruler may be cut off because it is no longer needed. The vertical ruler may be simply painted onto the vertical side of the support and need not be erased.

It is clearly understood that the mode of realisation of this invention which was described above, in reference to the annexed drawings, was given as an indication and is by no means restrictive, and which modifications and adaptations can be brought without the object deviating from all that the framework of this invention.

Other embodiments are possible and limited only by the scope of the appended claims.

I claim:

1. An adjustable support for steps to be fixed on a stringer having a number of steps and risers, said support comprising:

a generally flat body defining a set-square having a vertical side (26) and a horizontal side (24), said horizontal side being topped by a horizontal fold (32) to fix a step thereto, said horizontal side (24) comprising an extension defining an upper wide part (28) on said horizontal side and comprising means (55') of horizontal adjustment, said vertical side being topped with a vertical fold (34) to fix a riser thereto, said vertical side (26) comprising a lower wide part (30) comprising means of vertical adjustment (55), means for adjusting slope of said support thereby applying said slope to each said step and riser, said horizontal side being located above said stringer and said upper and lower wide parts being located facing said stringer in a position wherein said wide parts comprise means to tie to said stringer thereby uniting said wide parts and said stringer.

2. The adjustable support of claim 1 wherein said stringers define a stringer height and a stringer length and are spaced parallel to define between them a parallelepiped and said steps and risers are located within said parallelepiped.

3. The adjustable support of claim 2 wherein said horizontal side (24) is rectangular and comprises screws to maintain said steps fixed to said stringer, said vertical side (26) being rectangular and comprising screws to maintain said risers fixed to said stringer.

4. The adjustable support of claim 1 wherein said horizontal side (24) and said vertical side (26) each comprise two series of holes positioned close (46,52) and further apart (48,54) one of each series of holes receiving one screw for securing said supports when fixed to said stringer.

5. The support of claim 4 wherein said set-square forms a right-angle triangle of which the wide parts define the hypotenuse of said triangle.

6. The support of claim 5 wherein said hypotenuse is truncated, forming two opposed right-angle triangles.

7. The adjustable support of claim 1 wherein said means for adjustment comprise a ruler (55') projecting from said horizontal side (24) and a row of graduations (55) on said vertical side (26), an overlap between said ruler and said row of graduations serving to position said horizontal and vertical sides.

8. The support of claim 1 for use on a foot of a stringer (22), said stringer having a back part (29) disposed at an acute angle, said support comprising a base (25) positioned under said foot and prolonged in a strip (27) tied to said back (29) of said stringer (22).

9. The support of claim 7 wherein said flat body has a bearing face plane to coincide with said stringer, a working face plane and a thickness therebetween, said ruler projecting along a ruler plane positioned on said working face at a distance (141) at least equivalent to said thickness between said bearing face and said working face plane, said projecting part of ruler coinciding with said row of graduations of a next support along said stringer.

10. The support of claim 9 wherein said horizontal ruler (55') includes an upper edge (157) and said horizontal fold (32) includes an external face (152), when upper edge (157) is level with said external face(152).

11. The horizontal ruler (55') of claim 10 being removable, a single ruler being used successively to position one said support relatively to another during the installation of several said supports along said stringer of said staircase.

* * * * *